US007607751B2

(12) United States Patent
Geurts

(10) Patent No.: US 7,607,751 B2
(45) Date of Patent: Oct. 27, 2009

(54) METHOD FOR ALIGNING DROPLETS EXPELLED FROM AN INK JET PRINTER

(75) Inventor: Mathijs P. W. Geurts, Bergen (NL)

(73) Assignee: OCE-Technologies B.V., Venlo (NL)

( * ) Notice: Subject to any disclaimer, the term of this patent is extended or adjusted under 35 U.S.C. 154(b) by 388 days.

(21) Appl. No.: 11/595,950

(22) Filed: Nov. 13, 2006

(65) Prior Publication Data

US 2007/0109343 A1 May 17, 2007

(30) Foreign Application Priority Data

Nov. 14, 2005 (EP) ..... 05110702

(51) Int. Cl.
*B41J 29/393* (2006.01)

(52) U.S. Cl. ..... 347/19; 347/37

(58) Field of Classification Search ..... 347/9–12, 347/19, 41, 14, 37
See application file for complete search history.

(56) References Cited

U.S. PATENT DOCUMENTS

2004/0046813 A1 3/2004 Edamura et al.
2005/0083364 A1 4/2005 Billow

FOREIGN PATENT DOCUMENTS

EP 0 947 323 A2 10/1999
EP 0 982 139 A1 3/2000

*Primary Examiner*—Lamson D Nguyen
(74) *Attorney, Agent, or Firm*—Birch, Stewart, Kolasch & Birch, LLP

(57) ABSTRACT

A method of adjusting alignment positions of ink dots printed with at least one printhead that is mounted on a moving carriage of an ink jet printer includes printing ink dots on a testchart while the carriage moves over the testchart at a predetermined speed, measuring a relative dislocation (ΔY') of the ink dots, and correcting the alignment of the ink dots by adjusting the position and/or the timing of activation of the printhead in accordance with the measured result. The predetermined speed is smaller than a nominal speed that the carriage is moved over a recording medium in a print process. A misalignment of the ink dots that will be printed when the printhead is moved at the nominal speed is calculated from the measured dislocation (ΔY'), the predetermined speed and the nominal speed.

10 Claims, 3 Drawing Sheets

METHOD FOR ALIGNING DROPLETS EXPELLED FROM AN INK JET PRINTER

CROSS-REFERENCE TO RELATED APPLICATIONS

This nonprovisional Application claims priority under 35 U.S.C. § 119(a) on Patent Application No. 05110702.7, filed in the European Patent Office on Nov. 14, 2005, the entirety of which is incorporated herein by reference.

BACKGROUND OF THE INVENTION

1. Field of the Invention

The present invention relates to a method of adjusting the alignment positions of ink dots printed with at least one printhead that is mounted on a moving carriage of an ink jet printer. The method includes the steps of printing ink dots on a testchart while the carriage moves over the testchart with a predetermined speed, measuring a relative dislocation of the ink dots, and correcting the alignment of the ink dots by adjusting the timing of activation and/or the position of the printhead in accordance with the measured result.

2. Description of Background Art

An ink jet printer typically has one or more printheads mounted on a carriage that is moved over a recording medium in a main scanning direction Y. Thus an image swath consisting of a certain number of pixel lines, corresponding to the number of nozzles of the printhead, is printed during each pass of the carriage. Adjoining swaths of the image are printed in subsequent passes of the carriage, while the recording medium is intermittently advanced in a sub-scanning direction X normal to the main scanning direction Y. In order to obtain a good image quality at the transition from one swath to the other, the ink dots that are printed in different passes have to be aligned correctly in the sub-scanning direction.

However, when an ink droplet is expelled from a nozzle of a printhead, it has to travel a certain distance until it impinges on the recording medium. Since the printhead is moving in the main scanning direction, the ink droplet undergoes a certain speed-dependent aberration in that direction. This may lead to an alignment error between two ink dots that are printed in different passes. For example, when the printer is to be operated in a bi-directional print mode, i.e., a mode in which ink dots are printed in a forward pass and a return pass of the carriage, the aberration depends on the direction of travel of the carriage. The activation timings of the printhead, and hence the positions at which the pertinent nozzles are fired, must therefore be adjusted carefully, so that the different aberrations in the forward pass and the return pass are compensated for.

If the image is printed with a plurality of printheads mounted on the same carriage, the timings and the positions of the printheads on the carriage must be adjusted in order to make sure that the ink dots printed with different printheads have the correct positions relative to one another.

A high quality multi-color printer is preferably equipped with at least two printheads per color. The printheads for the different colors are arranged mirror-symmetrically. One set of color printheads is used only during the forward pass, and the other set of color printheads is used only during the return pass. This has the advantage that the ink dots of different colors will always be superposed in the same sequence, irrespective of the direction of travel of the carriage, so that the color composition will always be the same. However, if the printheads for the same color are not aligned correctly, the ink dots printed with these printheads in the forward and return passes of the carriage will be dislocated relative to one another, so that a thin line extending in the sub-scanning direction X will look rugged.

In a conventional method for checking and adjusting the alignment of the ink dots, the printer is used for printing a test pattern onto a testchart. In that print process, the operating conditions and parameters of the printer are the same as in a normal print operation. In particular, in view of the aberration effect, it is important that the test pattern be printed with a well-defined speed of the carriage. The test pattern on the testchart can then be inspected visually, e.g. with a microscope, or the positions of the ink dots on the testchart may be measured with an electro-optical sensor, in order to provide the data that are needed for correcting the activation timings and/or the printhead positions, if necessary.

A difficulty encountered in detecting the alignment of the ink dots is caused by the fact that, when a nozzle of an ink jet printhead is fired, it normally does not just expel a single droplet, but it first expels a relatively large droplet which is followed by one or more smaller droplets, the so-called satellites. Since the aberration of the satellites is different from that of the main droplet, the corresponding dots formed on the recording medium or the testchart are shifted relative to one another in the main scanning direction, which makes it difficult to detect the exact position of the dot.

SUMMARY OF THE INVENTION

It is an object of the present invention to provide a method for adjusting the alignment positions of ink dots, which can be performed with simple measuring equipment and which reduces errors that may be caused by satellites.

In order to achieve this object, according to an embodiment of the present invention, the carriage is moved at a predetermined speed when the test chart is printed. The predetermined speed is smaller than a nominal speed of the carriage when the carriage is moved over a recording medium during a print process. Misalignment of the ink dots that will be printed when the printhead is moved at the nominal speed is calculated from the measured dislocation, the predetermined speed and the nominal speed.

The present invention takes advantage of the fact that the satellites tend to be absorbed in the main dots when the speed of the carriage is reduced. Thus, by printing the testchart with a reduced carriage speed, errors resulting from the satellites can largely be eliminated. However, due to the reduced speed of the carriage, the aberration of the ink droplets is different from the aberration occurring during a normal print process. According to the present invention, calculating back from the measured aberration of the ink dots to the true aberration that will occur during the normal print process solves this problem. As a result, the alignment of the ink dots can be detected with improved accuracy. When a sensor, e.g. an opto-electronic sensor is used for measuring the positions of the ink dots, it is not necessary to employ a complicated and expensive high-resolution sensor that is capable of resolving the satellites and/or a satellite-induced distortion of the shape of the ink dots on the testchart.

It is also an object of the present invention to provide an apparatus for carrying out the method for adjusting the alignment positions of ink dots. The apparatus includes a printer in which the ink dots printed in the normal print mode are aligned in a specific way.

Preferably, the speed of the carriage used for printing on the testchart is reduced to such an extent that the satellites are almost completely absorbed in the main dots, so that the measured position of the ink dot corresponds to the position of the center of the main dot. Then, it is particularly easy to adjust the alignment of the printheads in such a way that the main dots printed with different printheads or in different passes are exactly aligned in the sub-scanning direction X. It has been found that, in terms of image quality, this type of alignment is superior to an alignment configuration in which the "centers of mass" of the ink dots, including the satellites, would be aligned. More particularly, a thin, one pixel-wide line extending in sub-scanning direction X appears sharper to the human eye when only the main dots are aligned, regardless of the satellites.

When the method according to the present invention is applied to a printer that shall be used (at least among others) for bi-directional printing, the test pattern on the testchart is printed while the carriage moves reciprocatingly in the main scanning direction Y, so that the effects of aberrations in opposite directions can be detected on the testchart. The alignment of the ink dots may be corrected either by mechanically adjusting the positions of the printheads on the carriage or by electronically adjusting the timings with which the nozzles of the printheads are fired.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
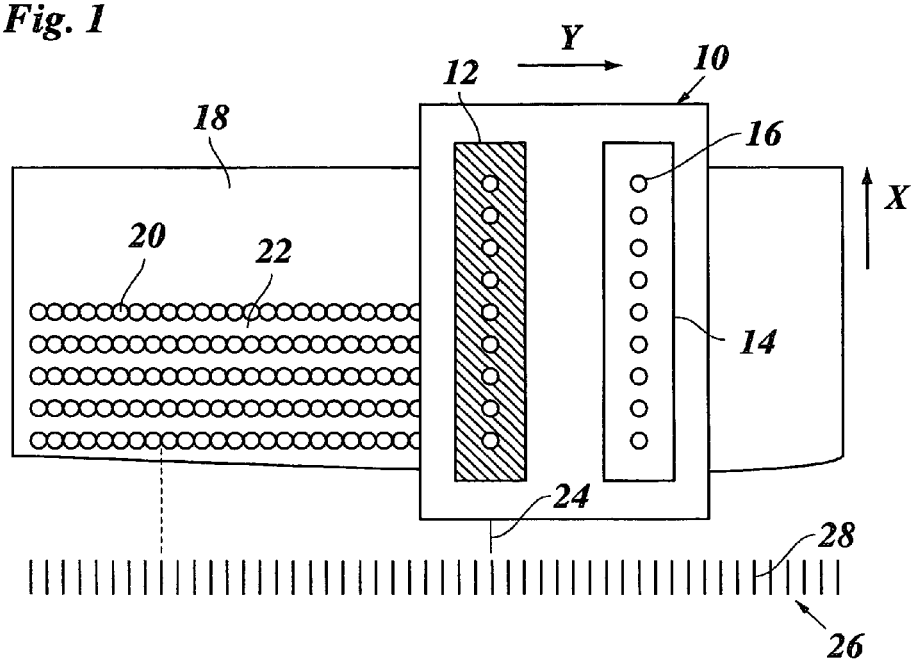
FIGS. 1 and 2 are diagrams illustrating a multi-pass print mode of an ink jet printer.

FIG. 1 schematically shows a carriage 10 of an ink jet printer. A number of printheads 12, 14 are mounted on the carriage 10. Although only two printheads 12, 14 have been shown in the drawing, it should be understood that the printer is a full color printer having additional printheads intervening between the two shown printheads 12, 14. The intervening printheads are used for printing the colors cyan, magenta and yellow, whereas the printheads 12, 14 are used for printing with black ink.

Each printhead 12, 14 has a row of nozzles 16 arranged in a sub-scanning direction X in which a sheet of a recording medium 18 is advanced step-wise. The carriage 10 is moved across the recording medium 18 in a main scanning direction Y normal to the sub-scanning direction X.

In FIG. 1, the carriage 10 moves from left to right, and the printhead 12 is active, so that some of its nozzles 16 print pixels or ink dots 20 onto the recording medium 18. It is observed that the ink dots 20 form pixel lines that are separated by gaps 22 having a width of one pixel.

As has only been shown symbolically in FIG. 1, the carriage 10 has a position detector 24 that cooperates with a ruler 26 for detecting the position of the carriage in the main scanning direction Y. Thus, nozzles of the printheads can be fired at appropriate timings for printing the ink dots 20 at the correct positions, in accordance with the image information to be printed. The ruler 26 defines a pixel raster which is symbolized here by raster marks 28 arranged with a pitch corresponding to exactly the width of one pixel, e.g. 42.33 μm for an image resolution of 600 dpi.

Figure 2:
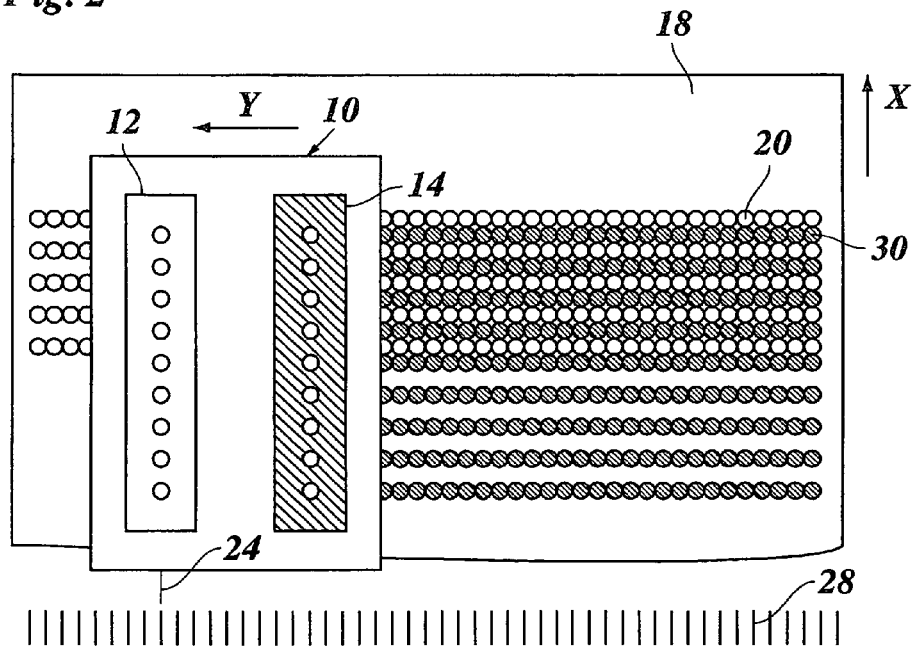

In FIG. 2, the recording medium 18 has been shifted one step in the X-direction, and the carriage 10 performs a return pass from right to left in the drawing. During this pass, the printhead 12 is inactive, while all the nozzles of the printhead 14 are active to print ink dots 30. Some of the dots 30 fill the gaps between the pixel lines that have been printed in the previous pass. In the lower part of the printed image, the dots 30 form pixel lines with gaps that will be filled in during the next pass of the carriage from left to right.

The two printheads 12, 14 must be aligned relative to one another with high precision. Ideally, the positions of the printheads 12, 14 on the carriage 10 and/or the timings at which the nozzles of these printheads are fired should be so adjusted that the (circular) ink dots 20 and 30 are exactly aligned with one another in the sub-scanning direction X. In practice; however, the ink dots 20 and 30 do not have an exact circular shape, but are accompanied by satellites 20*a* and 30*a*, as has been shown in FIG. 3. These satellites are due to the fact that, each time an ink droplet has been expelled from a nozzle, at least one smaller ink droplet is formed and will reach the surface of the print substrate a short time later. Since the carriage 10 is moving in the scanning direction Y, the satellites are shifted from the main dots to opposite sides, depending on the direction of movement of the carriage.

When the main dot 20 and its satellite 20*a* are inspected visually, without using a microscope, or when the dot position is measured with a sensor that does not have an extremely high resolution, the main dot and the satellite appear as a single dot. Therefore, the location thereof will be given by the "center of mass" 32 of the main dot and the satellite. Thus, when the measured dot positions are used for alignment of the printheads, the result will be that the centers of mass 32 are aligned, as is shown in FIG. 3.

Figure 3:
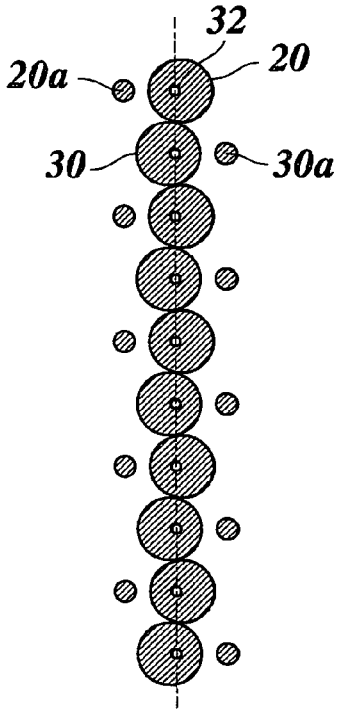
FIGS. 3 to 5 are enlarged views of test patterns printed with different alignment conditions of the printheads.
Figure 4:
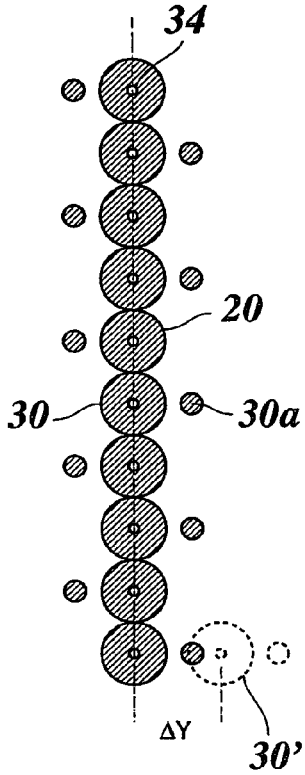

However, experience has shown that a single-pixel line gives a sharper impression if the ink dots are not aligned with their centers of mass 32, as in FIG. 3, but instead are aligned with the centers 34 of their main dots, as shown in FIG. 4. A misalignment ΔY of an individual ink dot 30' has also been shown (exaggeratedly) in FIG. 4.

Figure 5:
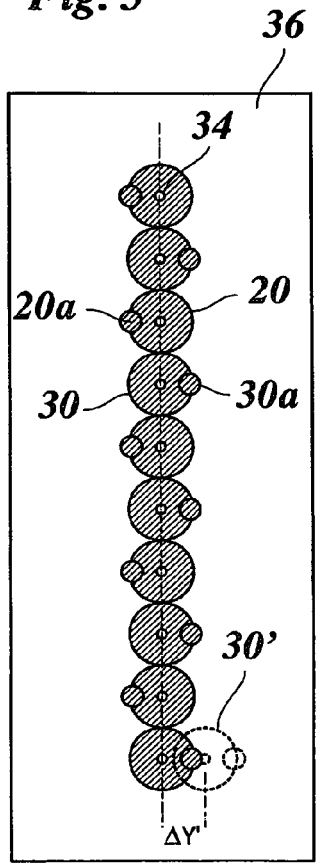

The present invention provides a method of achieving the alignment pattern of FIG. 4 without having to measure the dot positions with high resolution. To this end, a test pattern of ink dots 20, 30, as shown in FIG. 5, is printed on a testchart 36, with a reduced carriage speed. That is, the speed of the carriage is reduced in both the forward pass and the return pass. As a result, the aberration of the satellites 20*a*, 30*a* becomes smaller, and the satellites are completely or almost completely absorbed in their main dots. Thus, the apparent center of mass will coincide with the geometric center 34 of the main dot, so that the desired alignment may be achieved on the basis of the apparent centers of mass. However, the reduced carriage speed has also an effect on the aberration of the ink dots 20, 30, so that the measured dislocation ΔY' of the ink dot 30' will be different from the true misalignment ΔY in a print process under normal conditions.

It is possible; however, to calculate the true misalignment ΔY from the measured dislocation ΔY', as will be explained below with reference to FIGS. 6 and 7.

As can be seen in FIG. 1, the raster marks 28 are offset from the actual positions of the printed ink dots 20 by a half pitch, i.e. a half pixel width. The distance between the nozzles 16 of the printheads 12 and 14 is an integral multiple of the pixel width. When the carriage 10 moves to the right, as in FIG. 1, the nozzles of the printhead 12 are fired each time the position detector 24 passes a raster mark 28. The shift of the ink dots 20 by a half pixel width is due to an aberration of the ink droplets on their way from the nozzle to the recording medium 18. When the carriage 10 is moved with the same speed in the reverse direction, as in FIG. 2, the nozzles of the printhead 14 are also fired when the position detector 24 passes a raster mark 28, so that the ink dots 30 are also shifted by a half pixel width and will thus be aligned with the ink dots 20.

Figure 6:
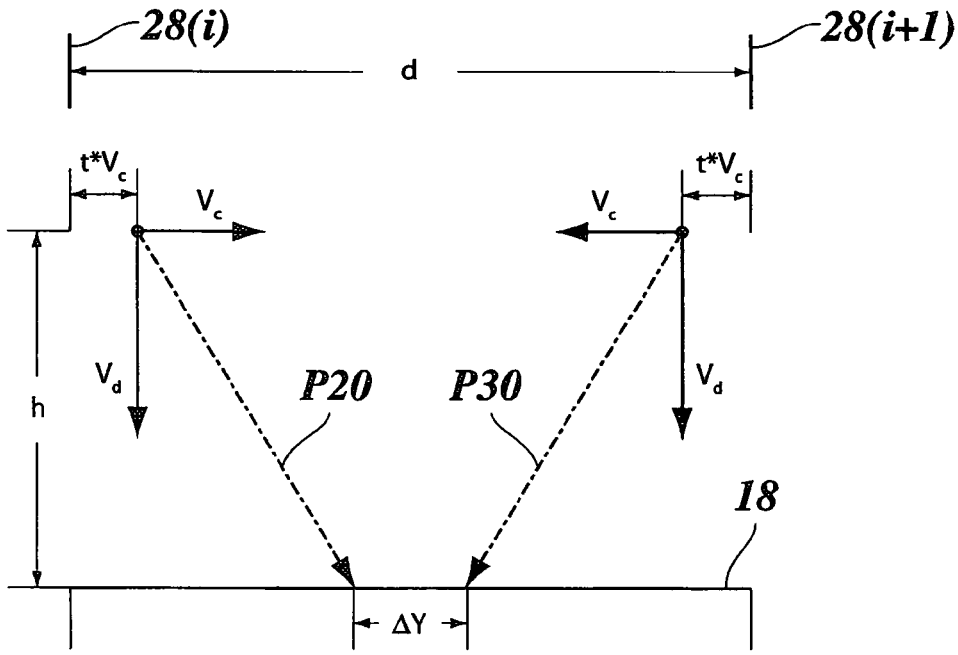
FIGS. 6 and 7 are diagrams explaining the effect of carriage speed on the positions of printed ink dots.

In FIG. 6, the distance between two adjacent raster marks 28(*i*) and 28(*i*+1) has been indicated as d. In the forward pass of the carriage, a signal to fire the nozzles is output when the position detector passes the raster mark 28(*i*), while the carriage 10 travels to the right with a speed $V_c$. Due to an inevitable time delay t in the electronics for energizing the nozzles of the printhead 12, the nozzles will have traveled a distance $t*V_c$ until an ink droplet is actually expelled from the nozzle. A droplet (and its satellite) moves towards the surface of the recording medium 18 with a speed $V_d$ and thus travels along a path P20. Thus, the position where the ink dot 20 is formed on the recording medium 18 is dependent on the speeds $V_c$ the $V_d$ and on the height h of the nozzle relative to the recording medium.

In the return pass (FIG. 2), the same holds true for the ink dots 30 that are expelled from the nozzles of the printhead 14, and these ink dots travel along a path P30. If the printheads 12, 14 are not aligned correctly, the ink dots 20 and 30 will show the misalignment ΔY.

Figure 7:
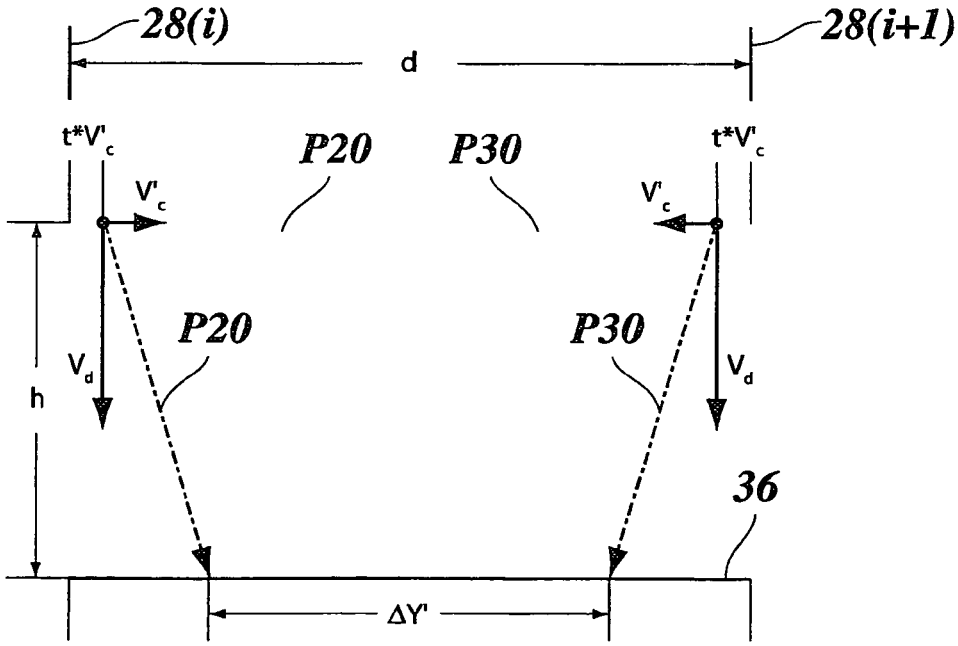

FIG. 7 is a corresponding diagram for the test print process, wherein the speed of the carriage 10 is reduced to $V'_c$ and the ink dots are printed on the testchart 36. When the alignment of the printheads 12, 14 is the same as in FIG. 6, the resulting dislocation of the ink dots 20 and 30 will be ΔY'.

A simple calculation shows that the actual misalignment ΔY of the ink dots is related to the measured dislocation ΔY' by the equation:

$$\Delta Y=(\Delta Y'-d)(V_c/V'_c)+d.$$

Thus, when the carriage speeds $V_c$ and $V_c'$ are known and the dislocation ΔY' (as in FIG. 5) is measured, the misalignment ΔY can be calculated, and the printheads 12, 14 can be adjusted in order to correct this misalignment. It is observed that the time delay t, the droplet speed $V_d$ and the height h do not appear in the above equation, which means that these quantities need not be known for carrying out the calculation. It should also be observed that the quantities ΔY' and ΔY should be considered as vectors, i.e. they may also assume negative values.

In this specific embodiment, the alignment pattern of FIG. 4 can be obtained by appropriately adjusting the distance between the printheads 12 and 14 and by adapting the timing control for the printheads such that the nozzles are fired right at the moment when the position detector 24 passes a raster mark 28. In a more general case, an alignment correction will involve a change in the timing control for the printheads.

Of course, the adjustment of the printheads achieved in the way described above will also be beneficial in a single-pass print mode, wherein the printheads 12 and 14 are used for bi-directional printing of subsequent stripes of an image, or in a case where the printhead 14 is used as a spare printhead for compensating nozzle failures in the other printhead 12 or vice versa.

In case of a printer having only a single printhead (per color) and adapted for bi-directional printing, the dislocation ΔY' can be detected, and the misalignment ΔY can be calculated in an analogous way. The alignment correction will then be achieved by delaying or advancing the timings at which the nozzles are fired in the forward and return passes of the printhead.

Figure 8:
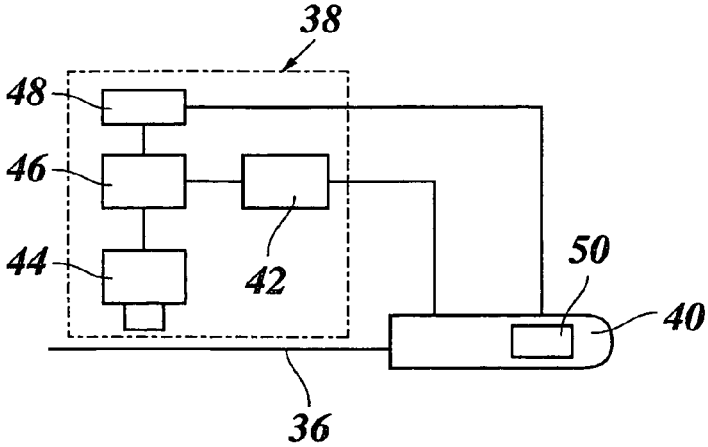
FIG. 8 is a block diagram of an apparatus that is suitable for carrying out the method according to the present invention.

FIG. 8 is a block diagram of an apparatus 38 that can be connected to a printer 40 for carrying out the alignment procedure described above. A control unit 42 of the apparatus 38 is connected to the printer 40 and measures or reads the nominal carriage speed $V_c$ that has been programmed in the printer 40. The control unit 42 then controls the printer 40 to reduce the carriage speed to $V'_c$. Using this reduced carriage speed $V'_c$, the printer 40 prints the test pattern onto the testchart 36.

The apparatus 38 further comprises an (low resolution) opto-electrical sensor 44 for measuring the dislocation ΔY' of the ink dots on the testchart 36, a processor 46 for calculating the misalignment ΔY, and an output unit 48 for outputting the misalignment ΔY.

Optionally, the output unit 48 may be configured to control the printer 40, so that the calculated misalignment is printed-out by the printer 40, e.g., directly on the testchart 36. As an alternative, the output unit 48 may be configured to re-program a timing control unit 50 of the printer 40 in such a way that the timings, at which the nozzles of the printheads 12, 14 are fired, are appropriately advanced or delayed relative to the timings when the position sensor 24 passes the raster marks 28, so that the misalignment is corrected electronically.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of adjusting alignment positions of ink dots printed with at least one printhead that is mounted on a moving carriage of an ink jet printer that moves at a specific predetermined nominal speed ($V_c$) of the carriage when the carriage is moved over a recording medium during a print process, said method comprising the steps of:

printing ink dots on a testchart while the carriage moves over the testchart at a predetermined speed ($V'_c$);

measuring a relative dislocation (ΔY') of the ink dots; and correcting the alignment of the ink dots by adjusting the position and/or the timing of activation of the printhead in accordance with the measured result, wherein said predetermined speed ($V'_c$) is smaller than the specific predetermined nominal speed ($V_c$) of the carriage when the carriage is moved over a recording medium during a print process, and a misalignment (ΔY) of the ink dots that will be printed when the printhead is moved at the specific predetermined nominal speed ($V_c$) is calculated from said measured relative dislocation (ΔY'), said predetermined speed ($V'_c$) and said specific predetermined nominal speed ($V_c$).

2. The method according to claim 1, further comprising the steps of: printing first ink dots on the test chart when the carriage moves at said predetermined speed ($V'_c$) in a first direction; printing second ink dots on the testchart when the carriage moves at the same predetermined speed ($V'_c$) in a second direction, opposite to said first direction; and measuring the relative dislocation ($\Delta Y'$) between the first and second ink dots.

3. A method of adjusting alignment positions of ink dots printed with at least one printhead that is mounted on a moving carriage of an ink jet printer that produces ink dots that are each composed of a main dot and at least one satellite, said method comprising the steps of:

printing ink dots an a testchart while the carriage moves over the testchart at a predetermined speed ($V'_c$);

measuring a relative dislocation ($\Delta Y'$) of the ink dots; and correcting the alignment of the ink dots by adjusting the position and/or the timing of activation of the printhead in accordance with the measured result; and reducing the predetermined speed ($V'_c$) relative to a specific predetermined nominal speed ($V_c$) to such an extent that the satellites are essentially absorbed in the main dots when the test chart is printed, wherein said predetermined speed ($V'_c$) is smaller than the specific predetermined nominal speed ($V_c$) of the carriage when the carriage is moved over a recording medium during a print process, and a misalignment ($\Delta Y$) of the ink dots that will be printed when the printhead is moved at the specific predetermined nominal speed ($V_c$) is calculated from said measured relative dislocation ($\Delta Y'$) said predetermined speed ($V'_c$) and said specific predetermined nominal speed ($V_c$).

4. The method according to claim 3, further comprising the steps of: printing first ink dots on the test chart when the carriage moves at said predetermined speed ($V'_c$) in a first direction; printing second ink dots on the testchart when the carriage moves at the same predetermined speed ($V'_c$) in a second direction, opposite to said first direction; and measuring the relative dislocation ($\Delta Y'$) between the first and second ink dots.

5. An apparatus for adjusting alignment positions of ink dots printed with at least one printhead that is mounted on a moving carriage of an ink jet printer that moves at a specific predetermined nominal speed ($V_c$) of the carriage when the carriage is moved over a recording medium during a print process, said apparatus comprising:

a control unit that controls the printer to move the carriage at a predetermined speed ($V'_c$) that is smaller than the specific predetermined nominal speed ($V_c$) of the carriage when the carriage is moved over a recording medium during a print process;

a sensor that detects a relative dislocation ($\Delta Y'$) of ink dots that have been printed with the printer on a testchart; and a processor that calculates a misalignment ($\Delta Y$) of the ink dots that will be printed when the printhead is moved at the specific predetermined nominal speed ($V_c$) on the basis of the detected relative dislocation ($\Delta Y'$), said predetermined speed ($V'_c$) and said specific predetermined nominal speed ($V_c$) of the carriage.

6. The apparatus of claim 5, wherein first ink dots are printed on the test chart when the carriage moves at said predetermined speed ($V'_c$) in a first direction, second ink dots are printed on the testchart when the carriage moves at the same predetermined speed ($V'_c$) in a second direction, opposite to said first direction, and said sensor detects the relative dislocation ($\Delta Y'$) between the first and second ink dots.

7. An apparatus for adjusting alignment positions of ink dots printed with at least one printhead that is mounted on a moving carriage of an ink jet printer that produces ink dots that are each composed of a main dot and at least one satellite, said apparatus comprising:

a control unit that controls the printer to move the carriage at a predetermined speed ($V'_c$) that is smaller than a the specific predetermined nominal speed ($V_c$) of the carriage when the carriage is moved over a recording medium during a print process;

a sensor that detects a relative dislocation ($\Delta Y'$) of ink dots that have been printed with the printer on a testchart; and a processor that calculates a misalignment ($\Delta Y$) of the ink dots that will be printed when the printhead is moved at the specific predetermined nominal speed ($V_c$) on the basis of the detected relative dislocation ($\Delta Y'$), said predetermined speed ($V'_c$) and said specific predetermined nominal speed ($V_c$) of the carriage, wherein said control unit reduces the predetermined speed ($V'_c$) relative to the specific predetermined nominal speed ($V_c$) to such an extent that the satellites are essentially absorbed in the main dots when the test chart is printed.

8. The apparatus according to claim 7, wherein first ink dots are printed on the test chart when the carriage moves at said predetermined speed ($V'_c$) in a first direction, second ink dots are printed on the testchart when the carriage moves at the same predetermined speed ($V'_c$) in a second direction, opposite to said first direction, and said sensor detects the relative dislocation ($\Delta Y'$) between the first and second ink dots.

9. A method of adjusting alignment positions of ink dots printed with at least one printhead that is mounted on a moving carriage of an ink jet printer, said method comprising the steps of:

printing ink dots on a testchart while the carriage moves over the testchart at a predetermined speed ($V'_c$) that is slower than a different predetermined nominal speed ($V_c$) at which the carriage moves in a making a normal print;

measuring a relative dislocation ($\Delta Y'$) of the ink dots printed on the test chart;

calculating a misalignment ($\Delta Y$) of the ink dots that will be printed when the printhead is moved at the different predetermined speed based on the relative dislocation ($\Delta Y'$); and correcting the alignment of the ink dots by adjusting the position and/or the timing of activation of the printhead in accordance with the measured relative dislocation ($\Delta Y'$).

10. A method of adjusting alignment positions of ink dots printed with at least one printhead that is mounted on a moving carriage of an ink jet printer, said method comprising the steps of:

printing ink dots made up of main drops and satellite drops on a testchart while the carriage moves over the testchart at a predetermined speed ($V'_c$) that is slower than a different predetermined nominal speed ($V_c$) at which the carriage moves in a making a normal print such that satellite dots are substantially completely absorbed in their main dots;

measuring a relative dislocation ($\Delta Y'$) of the ink dots printed on the test chart;

calculating a misalignment ($\Delta Y$) of the ink dots that will be printed when the printhead is moved at the different predetermined speed based on the relative dislocation ($\Delta Y'$); and correcting the alignment of the ink dots by adjusting the position and/or the timing of activation of the printhead in accordance with the measured relative dislocation ($\Delta Y'$).

* * * * *